US010809655B2

(12) United States Patent
Kume et al.

(10) Patent No.: US 10,809,655 B2
(45) Date of Patent: Oct. 20, 2020

(54) IMAGE FORMING APPARATUS AND CONTROL METHOD THEREOF PROVIDING DIFFERENT SPEED CONTROL OF DRIVING DEVELOPER CARRYING MEMBERS USING A COMMON DRIVE

(71) Applicant: CANON KABUSHIKI KAISHA, Tokyo (JP)

(72) Inventors: Takao Kume, Yokohama (JP); Toshihiko Takayama, Kawasaki (JP); Hideo Nanataki, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/566,139

(22) Filed: Sep. 10, 2019

(65) Prior Publication Data

US 2020/0089152 A1 Mar. 19, 2020

(30) Foreign Application Priority Data

Sep. 14, 2018 (JP) ..... 2018-172918

(51) Int. Cl.
*G03G 15/08* (2006.01)
*G03G 15/00* (2006.01)

(52) U.S. Cl.
CPC ..... *G03G 15/5041* (2013.01); *G03G 15/0822* (2013.01)

(58) Field of Classification Search
USPC ..... 399/49
See application file for complete search history.

(56) References Cited

U.S. PATENT DOCUMENTS

2016/0161883 A1* 6/2016 Ono ..... G03G 15/5008 399/53
2017/0235249 A1* 8/2017 Shindo ..... G03G 15/5008 399/49

FOREIGN PATENT DOCUMENTS

JP 10090960 A * 4/1998
JP 2011099933 A 5/2011
JP 2017146589 A 8/2017
(Continued)

OTHER PUBLICATIONS

Office Action issued in Japanese Appln. No. 2018-172918 dated Sep. 1, 2020.

*Primary Examiner* — Quana Grainger
(74) *Attorney, Agent, or Firm* — Rossi, Kimms & McDowell LLP

(57) ABSTRACT

An image forming apparatus includes: an image bearing member; a developer carrying member to correspond to the image bearing member; drive portion to rotationally drive the developer carrying member; control unit to control the rotational drive by the drive portion, and detection portion to detect information from the toner patch. Modes for controlling, by control unit, the rotational drive of the drive portion include (i) a first mode which uses a first driving condition including a first peripheral speed ratio between the developer carrying member and the image bearing member and (ii) a second mode which uses a second driving condition including a second peripheral speed ratio which is higher than the first peripheral speed ratio. The control unit controls the image bearing member to form the toner patch for each of peripheral speed ratios and sets the second driving condition on the basis of the detected information.

10 Claims, 15 Drawing Sheets

(56) References Cited

FOREIGN PATENT DOCUMENTS

| | | | |
|---|---|---|---|
| JP | 2018004688 | A | 1/2018 |
| JP | 2018087923 | A | 6/2018 |

* cited by examiner

IMAGE FORMING APPARATUS AND CONTROL METHOD THEREOF PROVIDING DIFFERENT SPEED CONTROL OF DRIVING DEVELOPER CARRYING MEMBERS USING A COMMON DRIVE

BACKGROUND OF THE INVENTION

Field of the Invention

The present invention relates to an image forming apparatus having a plurality of modes in which image formation is performed using different color gamuts.

Description of the Related Art

A color gamut is one of image quality indexes in an image forming apparatus. The color gamut in the image forming apparatus denotes a color reproduction range which can be outputted by the image forming apparatus. As the color gamut is wider, the color reproduction range is wider, and the image forming apparatus having the wider color reproduction range is excellent. A method for enlarging the color gamut conceivably includes a method in which, in addition to developers of four colors which are yellow (Y), magenta (M), cyan (C), and black (B), developers of dark YMCK are additionally added, or a method in which the amount of the developer on a recording material is increased by increasing the rotational speed of a developer carrying member which supplies the developer to an image bearing member. Japanese Patent Application Publication No. 2011-99933 proposes the technique of determining difference of the toner bearing amount of a toner image for measurement to set the toner bearing amount of a toner image at the time of image formation.

SUMMARY OF THE INVENTION

However, the above conventional art has the following problem. In the above technique, in the configuration in which the amount of the developer is increased by increasing the rotational speed of the developer carrying member which supplies the developer to the image bearing member, the developer carrying members of individual colors are driven at their respective desired rotational speeds, and hence a plurality of drive sources are used to drive the individual developer carrying members independently of each other. Consequently, the cost and size of the apparatus are increased.

The present invention has been made in view of the above problem, and an object thereof is to properly set a rotational speed difference or a rotational speed ratio between an image bearing member and a developer carrying member when a plurality of the developer carrying members are driven by using a common drive source.

In order to achieve the above object, an image forming apparatus according to the present invention includes:

a plurality of rotatable image bearing members;

a plurality of rotatable developer carrying members which are disposed so as to correspond to the plurality of image bearing members and which are configured to come into contact with the plurality of image bearing members to supply a developer to the plurality of image bearing members;

a drive portion configured to simultaneously perform rotational drive of at least two of the plurality of developer carrying members;

a control unit configured to control the rotational drive by the drive portion and formation of a toner patch by each of the plurality of image bearing members; and a detection portion configured to detect information related to the developer of the toner patch, wherein assuming that ratios between each of the at least two developer carrying members in the rotational drive and each of the image bearing members disposed so as to correspond to the at least two developer carrying members are represented by peripheral speed ratios, modes for controlling, by the control unit, the rotational drive of the drive portion include (i) a first mode which uses a first driving condition including a first peripheral speed ratio among the peripheral speed ratios, and (ii) a second mode which uses a second driving condition including a second peripheral speed ratio, among the peripheral speed ratios, which is higher than the first peripheral speed ratio, and the control unit configured to control the image bearing member to perform the formation of the toner patch for each of peripheral speed ratios, and set the second driving condition on the basis of the information of each toner patch formed for each of the peripheral speed ratios, the information being detected by the detection portion.

In addition, in order to achieve the above object, a method of controlling an image forming apparatus according to the present invention, the image forming apparatus including a plurality of rotatable image bearing members, a plurality of rotatable developer carrying members which are disposed so as to correspond to the plurality of image bearing members and which are configured to come into contact with the plurality of image bearing members to supply a developer to the plurality of image bearing members, a drive portion configured to simultaneously perform rotational drive of at least two of the plurality of developer carrying members, a control unit configured to control the rotational drive by the drive portion and formation of a toner patch by each of the plurality of image bearing members, and a detection portion configured to detect information related to the developer of the toner patch, the method includes:

controlling, by the control unit, the drive portion to perform the rotational drive in either one of the modes, assuming that ratios between each of the at least two developer carrying members in the rotational drive and each of the image bearing members disposed so as to correspond to the at least two developer carrying members are represented by peripheral speed ratios, of (i) a first mode which uses a first driving condition including a first peripheral speed ratio among the peripheral speed ratios and (ii) a second mode which uses a second driving condition including a second peripheral speed ratio, among the peripheral speed ratios, which is higher than the first peripheral speed ratio;

controlling, by the control unit, the image bearing member to perform the formation of the toner patch for each of peripheral speed ratios; and setting, by the control unit, the second driving condition on the basis of the information of each toner patch formed for each of the peripheral speed ratios, the information being detected by the detection portion when the control unit controls the rotational drive by the drive portion by using the second mode.

In addition, in order to achieve the above object, a non-transitory computer readable medium stores a program according to the present invention, wherein the program causes a computer to execute:

the steps, by control unit of an image forming apparatus, the image forming apparatus including a plurality of rotatable image bearing members, a plurality of rotatable developer carrying members which are disposed so as to correspond to the plurality of image bearing members and which are configured to come into contact with the plurality of image bearing members to supply a developer to the plurality of image bearing members, a drive portion configured to simultaneously perform rotational drive of at least two of the plurality of developer carrying members, a control unit configured to control the rotational drive by the drive portion and formation of a toner patch by each of the plurality of image bearing members, and a detection portion configured to detect information related to the developer of the toner patch, controlling, by the control unit, the drive portion to perform the rotational drive in either one of the modes, assuming that ratios between each of the at least two developer carrying members in the rotational drive and each of the image bearing members disposed so as to correspond to the at least two developer carrying members are represented by peripheral speed ratios, of (i) a first mode which uses a first driving condition including a first peripheral speed ratio among the peripheral speed ratios and (ii) a second mode which uses a second driving condition including a second peripheral speed ratio, among the peripheral speed ratios, which is higher than the first peripheral speed ratio;

controlling, by the control unit, the image bearing member to perform the formation of the toner patch for each of peripheral speed ratios; and setting, by the control unit, the second driving condition on the basis of the information of each toner patch formed for each of the peripheral speed ratios, the information being detected by the detection portion when the control unit controls the rotational drive by the drive portion by using the second mode.

According to the present invention, also in the configuration in which a plurality of the developer carrying members are rotated by using a common drive source, it is possible to properly set the rotational speed difference or the rotational speed ratio between the image bearing member and the developer carrying member.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Embodiment 1

Figure 1:
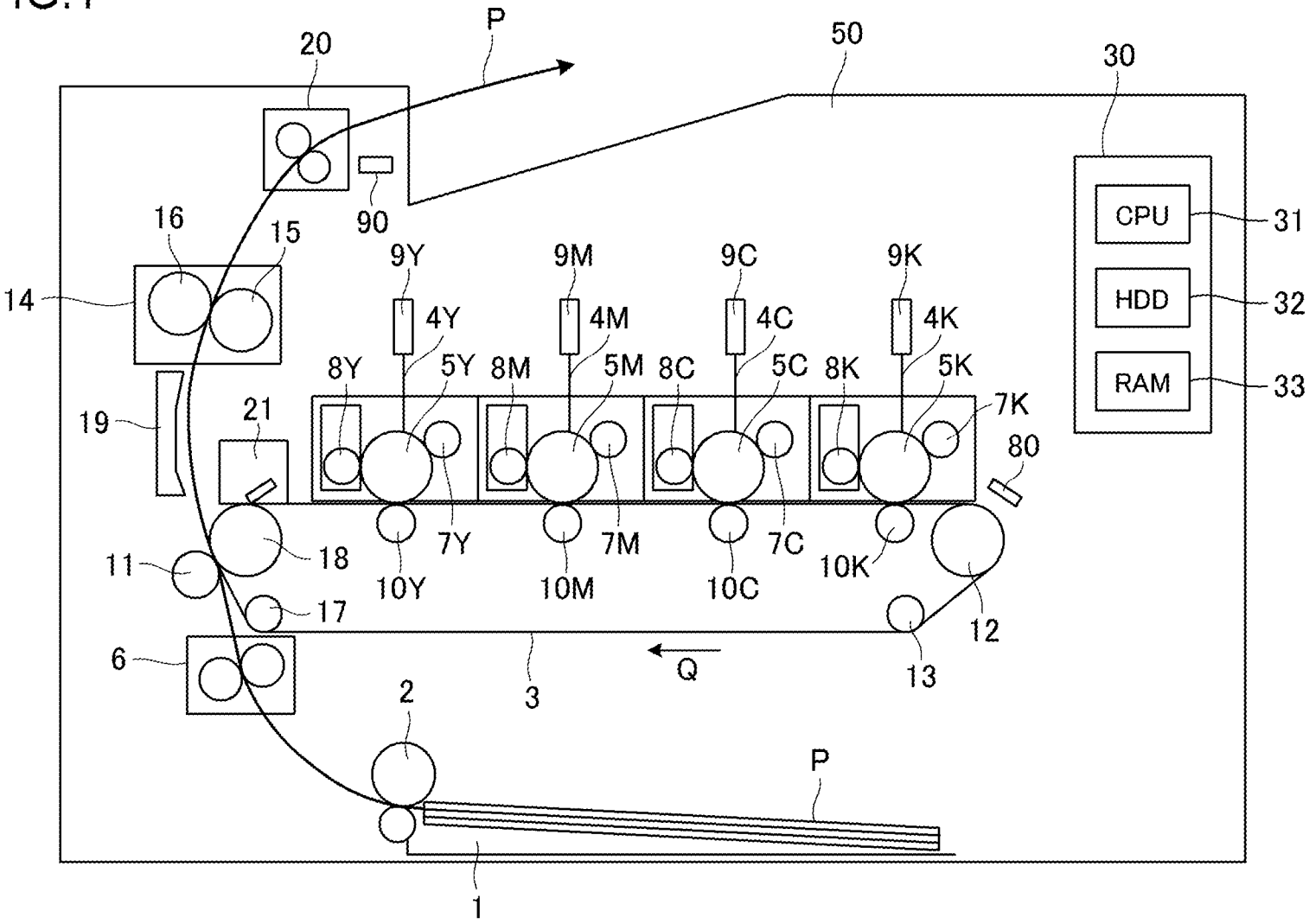
FIG. 1 is a schematic configuration diagram of an image forming apparatus in Embodiment 1.

Outline of Configuration of Image Forming Apparatus and Operation at Time of Image Formation FIG. 1 is a schematic configuration diagram related to a color laser printer (image forming apparatus) in Embodiment 1. As shown in FIG. 1, a color laser printer 50 has photosensitive drums 5 (5Y, 5M, 5C, 5K) serving as a plurality of first image bearing members. The color laser printer 50 is a four-drum (in-line) printer which successively performs multiple transfer of images on an intermediate transfer belt 3 (transfer member) serving as a second image bearing member to obtain a full-color print image. The image forming apparatus in Embodiment 1 is, e.g., a printer which is capable of outputting an image on a paper sheet having the A4 size (210 mm×297 mm) or smaller and has a resolution of 600 dpi and a printing speed of 20 ppm. Transfer portion in the image forming apparatus in Embodiment 1 has portion for performing primary transfer from the photosensitive drum to the intermediate transfer belt and portion for performing secondary transfer from the intermediate transfer belt to a recording material.

The intermediate transfer belt 3 of the color laser printer 50 is an endless belt, and is wound around a driver roller 12, a tension roller 13, an idler roller 17, and a secondary transfer opposing roller 18. The intermediate transfer belt 3 rotates at a process speed of 100 mm/s in a direction of an arrow Q in the drawing. As the material of the intermediate transfer belt 3, polyimide, polyamide, polycarbonate (PC), and polyvinylidene fluoride (PVDF) are used. Each of the driver roller 12, the tension roller 13, and the secondary transfer opposing roller 18 is a supporting roller which supports the intermediate transfer belt 3.

In total, four photosensitive drums 5, which correspond to individual colors, are disposed in series along a movement direction of the intermediate transfer belt 3. The photosensitive drum 5Y having a developing device (developing unit) of yellow (Y) is uniformly charged so as to have a predetermined polarity and a predetermined potential by a primary charging roller (charging portion) 7Y in the process of rotation. Subsequently, the photosensitive drum 5Y receives an image exposure 4Y by image exposure unit (exposure portion) 9Y, and an electrostatic latent image corresponding to a first color (yellow) component image of a target color image is thereby formed. Then, the electrostatic latent image is developed using a yellow toner (developer) serving as the first color by a developing roller 8Y serving as a developer carrying member. A method in which the toner is developed in a portion where the electrostatic latent image is formed by the image exposure in the manner described above is referred to as a "reversal development method".

The yellow image formed on the photosensitive drum 5Y enters a primary transfer nip portion with the intermediate transfer belt 3. In the primary transfer nip portion, a voltage applying member (primary transfer roller) 10Y is caused to come into contact with and abut on the back side of the intermediate transfer belt 3, i.e., a back surface of a surface facing the photosensitive drum 5Y. The voltage applying member 10Y has a primary transfer bias power source to allow independent bias application by each port. To the intermediate transfer belt 3, yellow is transferred through the port of the first color, and the individual colors which are magenta, cyan, and black are sequentially transferred by multiple transfer through their respective ports by the photosensitive drums 5M, 5C, and 5K corresponding to the individual colors which have been subjected to the steps described above. A toner image having four colors transferred onto the intermediate transfer belt 3 moves in the direction of the arrow Q in the drawing, i.e., clockwise as the intermediate transfer belt 3 moves.

Meanwhile, a recording material P stacked and stored in a paper feed cassette 1 is fed by a paper feed roller 2, is transported to a nip portion of a resist roller pair 6 and is temporarily stopped at the nip portion. The temporarily stopped recording material P is fed to a secondary transfer nip by the resist roller pair 6 in synchronization with the arrival of the toner image having four colors formed on the intermediate transfer belt 3 at the secondary transfer nip. Subsequently, the toner image on the intermediate transfer belt 3 is transferred onto the recording material P by voltage application (about +1.5 kV) between a secondary transfer roller 11 and the secondary transfer opposing roller 18. The recording material P to which the toner image has been transferred is separated from the intermediate transfer belt 3 and is sent to a fixing apparatus 14 serving as fixing portion by a transport guide 19. In the fixing apparatus 14, the recording material P is heated and pressed by a fixing roller 15 and a pressing roller 16, and the toner image is melted and fixed to the surface of the recording material P. As a result, a full color image having four colors is obtained. Subsequently, the recording material P is discharged to the outside of the apparatus from a paper discharge roller pair 20, and one cycle of the print is ended. Meanwhile, the toner which has not been transferred to the recording material P in the secondary transfer described above and remains on the intermediate transfer belt 3 is removed by a cleaning unit 21 disposed downstream of the position of the transfer to the recording material P on the belt.

In addition, the color laser printer 50 has a control section 30 serving as control unit for controlling the operation of each section in the apparatus and communicating with each section. The control section 30 includes a CPU 31, an HDD 32 which is a non-volatile memory in which a program for causing the CPU 31 to perform control and various data are stored, and a RAM 33 which is a random-access memory serving as a work area for data processing.

Figure 2:
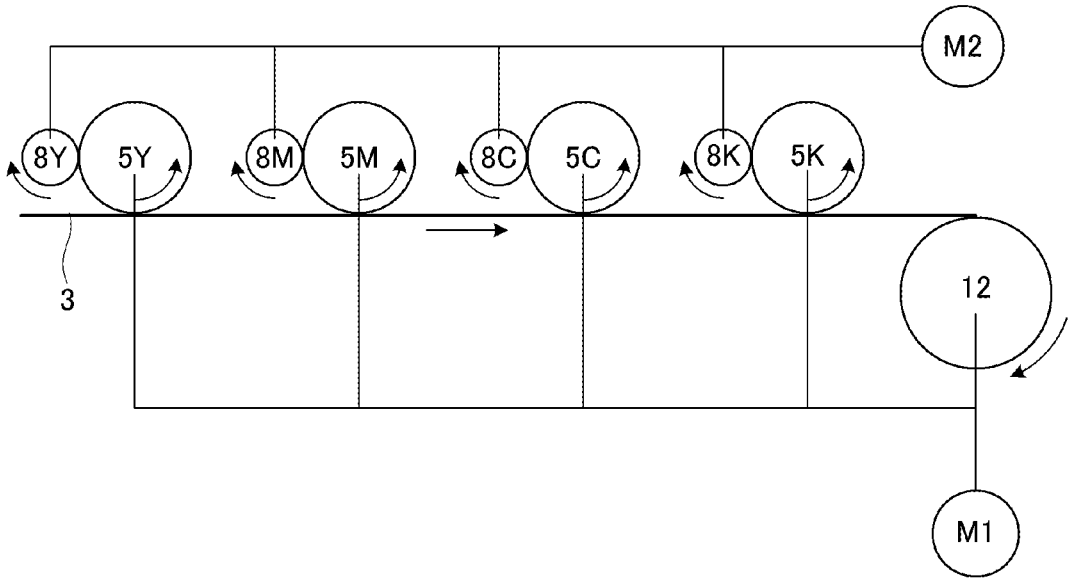
FIG. 2 is a schematic configuration diagram of drive sources of photosensitive drums and developing rollers in Embodiment 1.

Next, FIG. 2 shows an example of the configuration of the photosensitive drums 5 (5Y, 5M, 5C, 5K), the developing rollers 8 (8Y, 8M, 8C, 8K), and the driver roller 12 which performs rotational drive of the intermediate transfer belt 3 in Embodiment 1. The photosensitive drums 5 (5Y, 5M, 5C, 5K) and the driver roller 12 for the intermediate transfer belt 3 are rotated in their respective arrow directions by a drive motor M1 serving as common drive portion. In addition, the developing rollers 8Y, 8M, 8C, and 8K are rotated in their respective arrow directions by a common drive motor M2. Note that the photosensitive drum 5 and the developing roller 8 are driven by different drive sources, and hence the photosensitive drum 5 and the developing roller 8 can be rotated at their respective desired rotational speeds. In the configuration in Embodiment 1, the type of image formation executed by the color laser printer 50 includes a wide color gamut print mode serving as a wide color gamut image formation mode in addition to a normal print mode serving as a normal image formation mode. In the wide color gamut print mode, drive control is performed such that a ratio of the rotational speed of the developing roller 8 to the rotational speed of the photosensitive drum 5 (hereinafter referred to as a peripheral speed ratio) is higher than that in the normal print mode. Accordingly, a toner amount per unit surface area on the photosensitive drum 5 is increased and, consequently, wide color gamut image formation is implemented. Note that the normal print mode is an example of a first mode, and the wide color gamut print mode is an example of a second mode.

Figure 3:
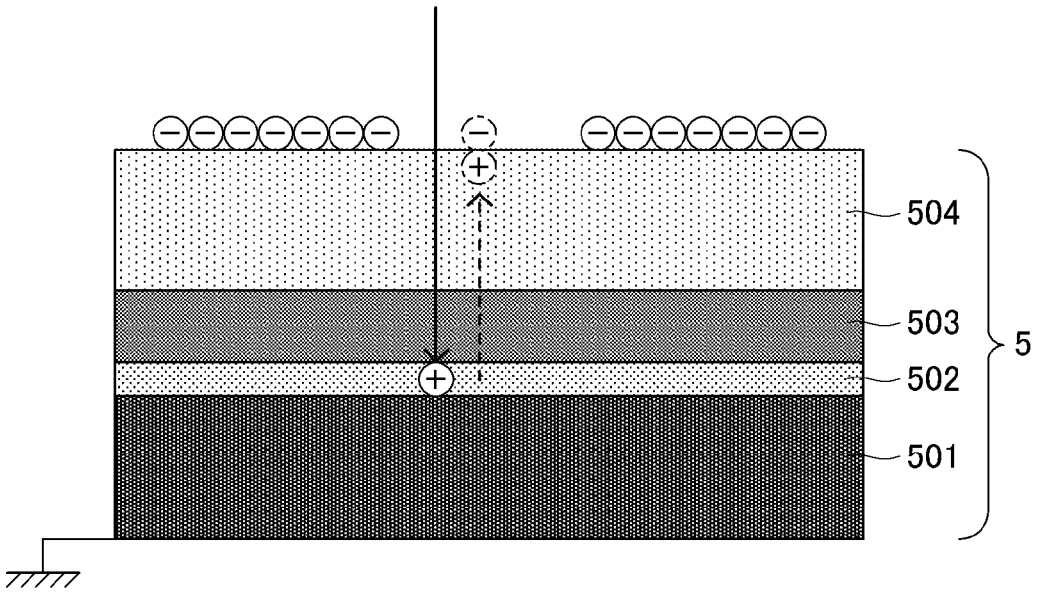
FIG. 3 is a schematic explanatory view of the layer structure of the photosensitive drum in Embodiment 1.

With Regard to Configuration and Potential Setting of Photosensitive Drum FIG. 3 shows the layer structure of the photosensitive drum 5. Main layers provided in the photosensitive drum 5 include, from below, a drum substrate 501 formed of a conductive material such as aluminum, an undercoat layer 502 which reduces light interference and improves adhesion of an upper layer, a charge generation layer 503 which generates a carrier, and a charge transport layer 504 which transports the generated carrier. The drum substrate 501 is grounded, and the surface of the photosensitive drum 5 is charged by the charging roller 7 and an electric field directed from the inside of the photosensitive drum 5 toward the outside is thereby formed. When the photosensitive drum 5 is irradiated with light emitted from a scanner unit 9, the carrier is generated in the charge generation layer 503. The generated carrier is caused to move toward the surface of the photosensitive drum 5 by the above electric field and is paired with the charge on the surface of the photosensitive drum 5, whereby the surface potential of the photosensitive drum 5 is changed.

Next, the potential of the surface of the photosensitive drum 5 in each of the normal print mode and the wide color gamut print mode will be described with reference to FIG. 4. First, the surface potential of the photosensitive drum 5 when the surface of the photosensitive drum 5 is charged by the charging roller 7 is set as a charge potential Vd. Thereafter, the surface potential of the photosensitive drum 5 is changed to an exposure potential V1 by exposure.

Herein, voltage is applied to the developing roller 8 by a high-voltage power source such that the developing roller 8 has a developing potential Vdc. The developing potential Vdc is set to a value between the exposure potential V1 and the charge potential Vd. Accordingly, in a portion which is not exposed (non-exposed portion), the electric field is formed in a direction opposite to a direction in which the toner coated on the surface of the developing roller 8 is developed on the side of the photosensitive drum 5. In addition, in a portion which is exposed (exposed portion), the electric field is formed in the direction in which the toner is developed on the side of the photosensitive drum 5. The toner is developed by the electric field in the exposed portion. The surface potential of the photosensitive drum 5 rises due to toner charge as the toner is developed, and hence the electric field in the exposed portion is weakened.

Figure 4:
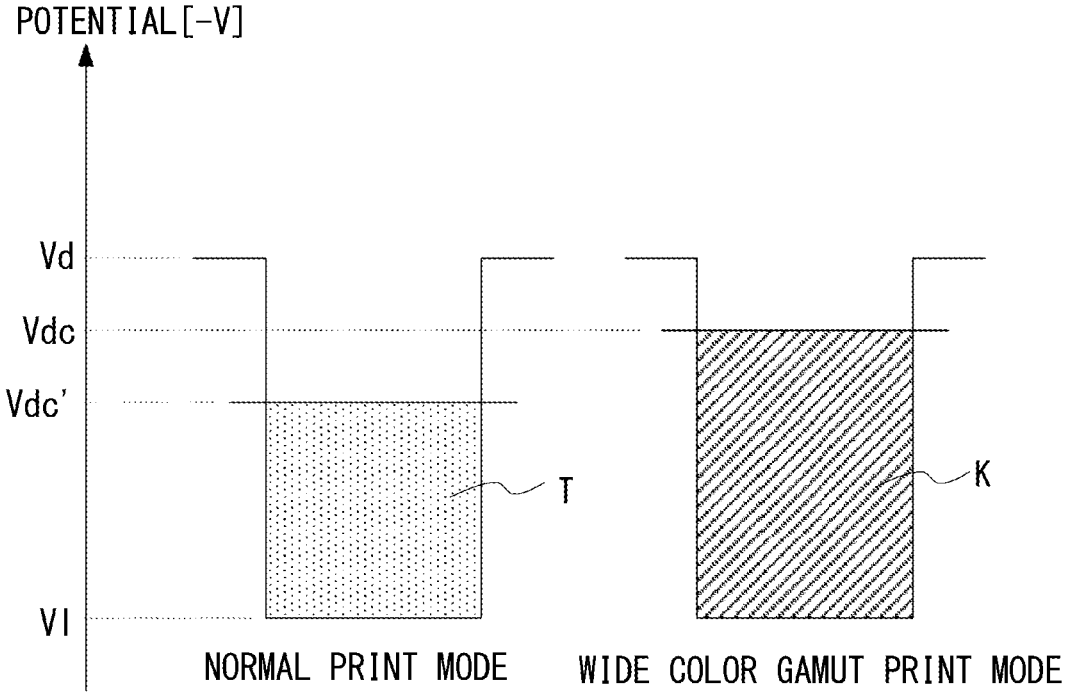
FIG. 4 is a schematic explanatory view of a photosensitive drum surface potential in Embodiment 1.

Accordingly, in the case of a toner supply amount in the normal print mode, an entire area K of the potential Vdc is not used as what is called a solid density in an image portion having an image area larger than that of a line image and, in FIG. 4, only an area T of a potential Vdc' smaller than that of the potential Vdc is used. Therefore, in the color laser printer 50, the drive control which increases the peripheral speed ratio is performed, the toner supply amount is increased, and the peripheral speed ratio is increased until the entire area K which saturates the toner amount on the photosensitive drum 5 is used.

With Regard to Detection Portion for Detecting Density Information of Test Toner Patch Next, a description will be given of an optical sensor 80 serving as one of detection portion of the color laser printer 50 in Embodiment 1. The optical sensor 80 detects a test toner patch which is a predetermined pattern formed on the intermediate transfer belt 3. The toner patch moves in the rotation direction of the belt together with the intermediate transfer belt 3 and diffuses and reflects infrared light emitted from a light-emitting element 81 when the toner patch passes through the optical sensor 80. The reflected light from the toner patch is received by a light-receiving element 82, and the position of the toner patch of each color is identified on the basis of information on the received reflected light.

Figure 5:
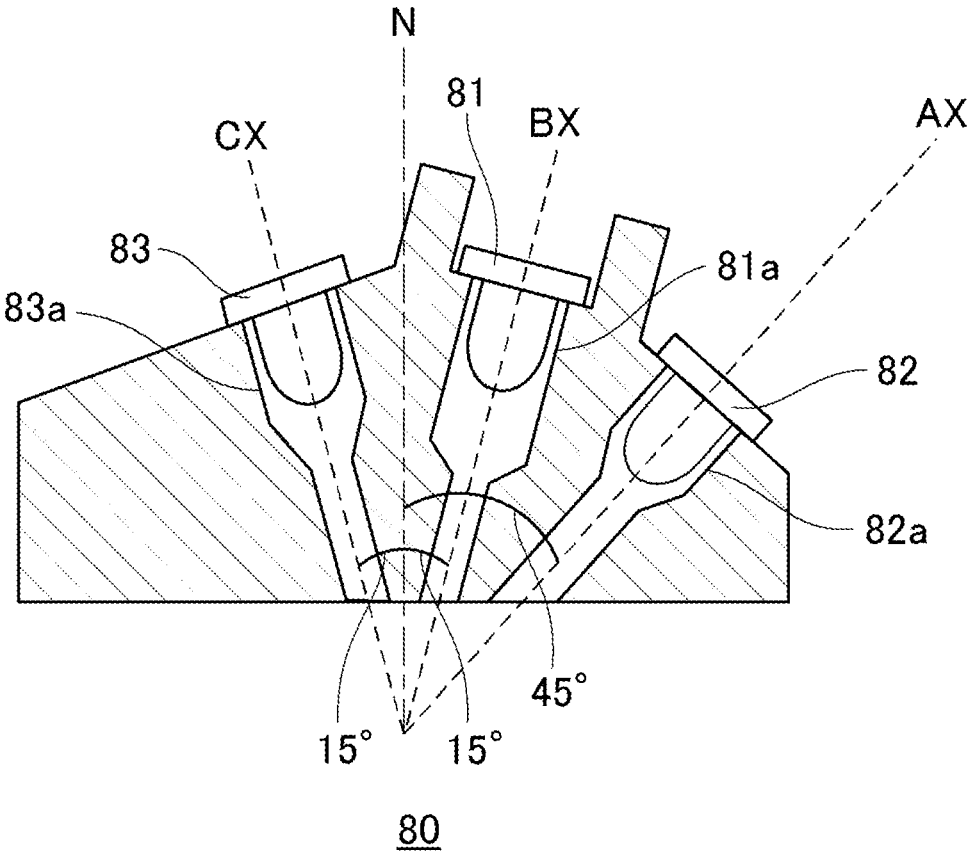
FIG. 5 is a schematic explanatory view of the configuration of an optical sensor in Embodiment 1.

FIG. 5 is a cross-sectional view of the optical sensor 80. The optical sensor 80 includes the light-emitting element 81 such as a light-emitting diode (LED), two light-receiving elements 82 and 83 such as phototransistors, and holders 81*a*, 82*a*, and 83*a* which hold the light-emitting element 81 and the light-receiving elements 82 and 83. The light-emitting element 81 is disposed such that its optical axis AX has an inclination of 15° with respect to the normal N to the surface of the intermediate transfer belt 3, and emits infrared light (e.g., a wavelength of 950 nm) to irradiate the toner patch on the intermediate transfer belt 3 or the surface of the intermediate transfer belt 3. The light-receiving element 82 is disposed such that its optical axis BX has an inclination of 45° with respect to the normal N to the surface of the intermediate transfer belt 3, and receives infrared light diffused and reflected from the toner patch or the surface of the intermediate transfer belt 3. The light-receiving element 83 is disposed such that its optical axis CX has an inclination of 15° with respect to the normal N to the surface of the intermediate transfer belt 3 and receives infrared light which is a regular reflection component from the toner patch or the surface of the intermediate transfer belt 3.

Next, a description will be given of a color sensor 90 which is one of the detection portion of the color laser printer 50 in Embodiment 1. The color sensor 90 is disposed, e.g., at a stage subsequent to the paper discharge roller pair 20, detects the toner patch fixed to the recording material P, and acquires a value related to a tinge (hereinafter referred to as color information). Note that the color sensor 90 is disposed so as to detect the central portion of the recording material P. However, the disposition of the color sensor 90 is not limited thereto. The color sensor 90 may be disposed so as to detect a portion other than the central portion, and a plurality of the color sensors 90 may be disposed. The position where the color sensor 90 is disposed is not limited to the stage subsequent to the paper discharge roller pair. The color sensor 90 may be disposed at a stage prior to the paper discharge roller pair 20, e.g., between the fixing apparatus 14 and the paper discharge roller pair 20 as long as the color sensor 90 can detect the toner patch fixed to the recording material P. In addition, the color sensor 90 may also be disposed at a stage prior to the fixing apparatus 14.

Figure 6:
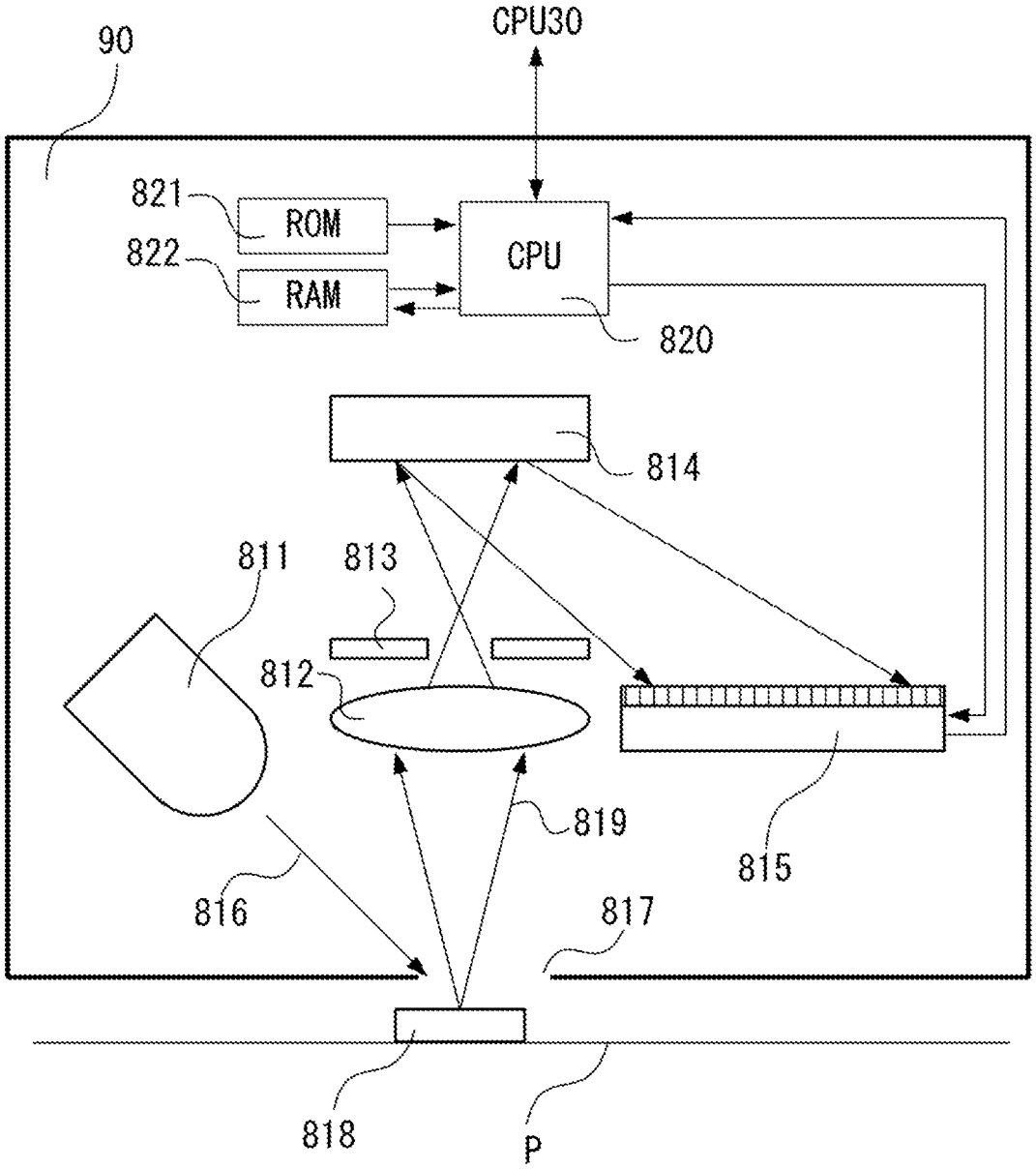
FIG. 6 is a schematic explanatory view of the configuration of a color sensor in Embodiment 1.

FIG. 6 is a schematic configuration diagram of the color sensor 90 which is a spectral colorimeter. The color sensor 90 has a white light source 811 which has an emission wavelength distribution over entire visible light, a condenser lens 812, a slit 813, a diffraction grating 814, and a line sensor 815 which includes a plurality of light-receiving elements. In addition, the color sensor 90 includes a CPU 820 which performs control of the color sensor 90 and arithmetic calculation. Further, the color sensor 90 includes a ROM 821 which is a read only memory into which a program for causing the CPU 820 to perform control and various data required for the arithmetic calculation are written, and a RAM 822 which is a random-access memory serving as a work area for data processing.

Light 816 emitted from the white light source 811 passes through an opening 817, becomes incident on a detection image 818 (toner patch) serving as a colorimetry target formed on the recording material P at an angle of about 45°, and becomes scattered light 819 corresponding to light absorption characteristics of the detection image 818. Part of the scattered light 819 is caused to pass through the slit 813 by the condenser lens 812, becomes incident on the diffraction grating 814, and is spectrally dispersed. The spectrally dispersed scattered light becomes incident on the line sensor 815, and the line sensor 815 outputs a signal corresponding to an incident light amount using each light-receiving element. The signal outputted from the line sensor 815 is inputted to the CPU 820. The CPU 820 performs predetermined arithmetic calculation on the output from each light-receiving element which has been inputted to the CPU 820 from the line sensor 815 and calculates spectral reflectance in a range from 380 nm to 730 nm at intervals of 10 nm (nanometer). The CPU 820 can further perform arithmetic calculation on the spectral reflectance to calculate chromaticity values such as XYZ (CIE/XYZ) and L*a*b* (CIE/L*a*b*) prescribed by Commission Internationale de l'Éclairage (CIE: International Commission on Illumination). The color sensor 90 can communicate with the CPU 31 of the color laser printer 50, and the CPU 31 can receive the chromaticity value L*a*b* calculated in the color sensor 90. Note that the signal of the line sensor 815 may be outputted to the CPU 31, and the CPU 31 may calculate the spectral reflectance and the chromaticity value.

The color sensor 90 is usually used for tinge matching of an image formed on the recording material P by the color laser printer 50. The CPU 31 forms the detection images 818 having various colors on the recording material P and fixes the detection images 818 to the recording material P, and then acquires the chromaticity value L*a*b* using the color sensor 90. The CPU 31 associates the chromaticity value L*a*b* of each detection image with image data when each detection image is formed using the color sensor 90. The CPU 31 changes a color table for color conversion which is used by an image processing section of the color laser printer 50 on the basis of the result of the association, whereby it becomes possible to form an image having a predetermined tinge.

Figure 7:
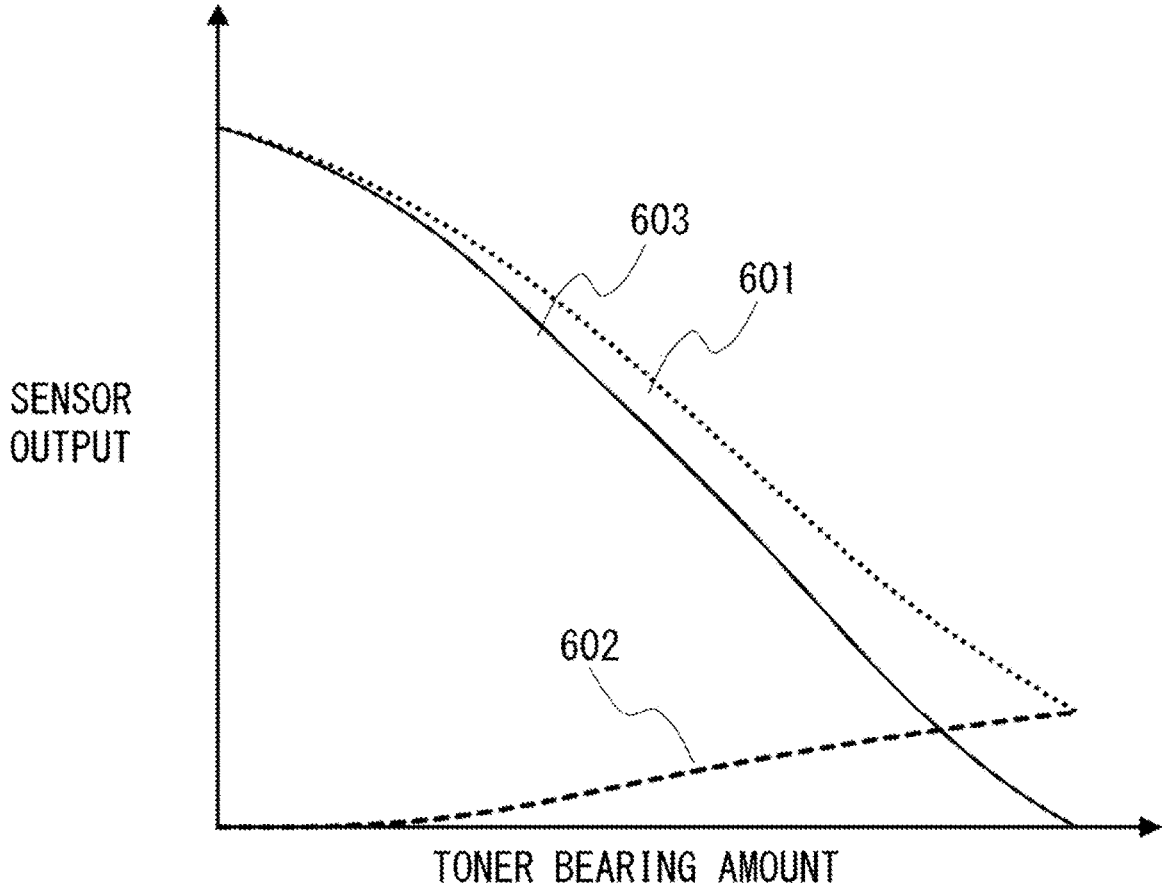
FIG. 7 is a schematic explanatory view of an optical sensor output in Embodiment 1.

FIG. 7 shows a graph indicative of the sensor output result of the optical sensor 80. Note that the horizontal axis of the graph indicates a toner bearing amount of the toner patch in the intermediate transfer belt 3, while the vertical axis of the graph indicates the output of the optical sensor 80. In the case of a toner image having a low toner bearing amount, an influence of reflected light from the surface of the intermediate transfer belt 3 which is flat, mirror-finished, and black is significant, and hence a regular reflection detection output 601 of the optical sensor 80 is large, and an irregular reflection detection output 602 thereof is small. In addition, a toner particle diameter is large as compared with surface properties (asperities of the surface) of the intermediate transfer belt 3, and hence, when the toner laid-on level is increased, the regular reflection detection output 601 of the optical sensor 80 is reduced, and the irregular reflection detection output 602 thereof is increased. Herein, the regular reflection detection output 601 includes an irregular reflection component caused by the toner patch, and hence it is possible to obtain a sensor output 603 correlated with the density of the toner patch by removing the irregular reflection component from the regular reflection detection output 601 on the basis of the irregular reflection detection output 602. With the foregoing, the density is calculated on the basis of the detection results of regularly reflected light and irregularly reflected light.

In Embodiment 1, the optical sensor 80 acquires information on the toner patch which is formed at a timing different from that during normal image formation. Specific examples of the toner patch include a registration detection patch for detecting an amount of registration displacement in which registration positions of developers of individual colors are displaced from each other, and a density control patch.

With Regard to Peripheral Speed Ratio of Developing Roller in Wide Color Gamut Print Mode With regard to the peripheral speed ratio of the developing roller 8 with respect to the photosensitive drum 5 in the wide color gamut print mode, as shown in FIG. 4, it is necessary to obtain the toner supply amount which allows the entire area K of the potential Vdc to be used as the solid density. Meanwhile, when the peripheral speed ratio is excessively high, the toner supply amount becomes excessively large, charge control of the toner becomes difficult, and a so-called fogging image, caused by developing toner is developed in a portion which has a charge potential Vd and which is not exposed, occurs. When the peripheral speed ratio is excessively low, the toner supply amount is small, and the wide color gamut image formation thus may not be implemented.

In Embodiment 1, the preferable peripheral speed ratio of the developing roller 8 is identified from the density information of the toner patch formed for each of a plurality of the peripheral speed ratios of the developing roller 8. More specifically, the tendency of an ideal density increase by the peripheral speed ratio is identified from the density information of the toner patches which has been formed according to the peripheral speed ratio in the normal print mode and the peripheral speed ratio in the vicinity of the peripheral speed ratio in the normal print mode. Subsequently, the peripheral speed ratio at the density deviating from the density indicated by the identified tendency is used as a limit value of the peripheral speed ratio when the developing roller 8 is driven. This can solve the problem when the toner supply amount is excessively large or small.

Figure 8:
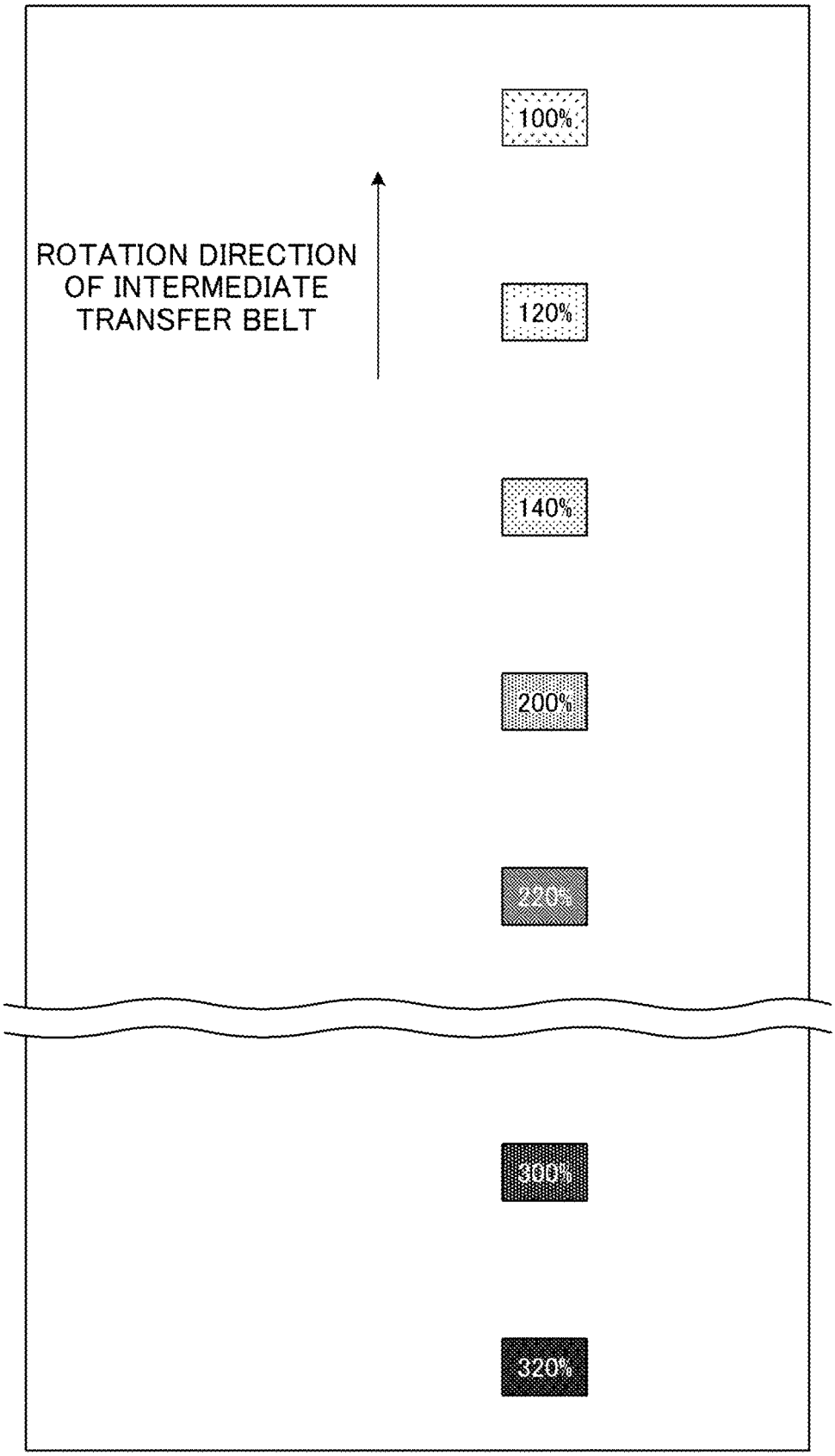
FIG. 8 is a schematic explanatory view of a test toner patch in Embodiment 1.

In Embodiment 1, in the toner image of each color, the peripheral speed ratio in the normal print mode is assumed to be 100%. Subsequently, the rotational speed of the developing roller 8 is increased, and the toner patches when the peripheral speed ratio is 120%, 140%, 200%, 220%, 240%, 260%, 280%, 300%, and 320% are formed. FIG. 8 shows an example of the toner patch corresponding to each peripheral speed ratio which is formed on the intermediate transfer belt 3. For example, the peripheral speed ratio can be increased by reducing the rotational speed of the photosensitive drum 5 and maintaining or increasing the rotational speed of the developing roller 8.

As shown in FIG. 8, on the intermediate transfer belt 3, the toner patches are formed so as to be arranged along the rotation direction (movement direction) of the belt. As an example, with regard to the size of the toner patch, the toner patch is formed into a rectangular shape which is 30 mm long in a main scanning direction and 20 mm long in a sub-scanning direction such that the toner patch falls within the cycle of the developing roller 8 of 48 mm. In addition, the toner patches are disposed such that an entire series of the patches falls within the cycle of the intermediate transfer belt 3. Further, an interval between adjacent patches is set to an interval corresponding to about two cycles of the developing roller 8 correspondingly to switching of the rotational speed of the developing roller 8. In Embodiment 1, as an example, while the cycle of the intermediate transfer belt 3 is set to 712 mm, the interval of the toner patches is set to 50 mm. In Embodiment 1, as described above, the reflected light from each toner patch is detected by the optical sensor 80, and the limit value of the peripheral speed ratio of each color toner is identified on the basis of the detection result.

Figure 9:
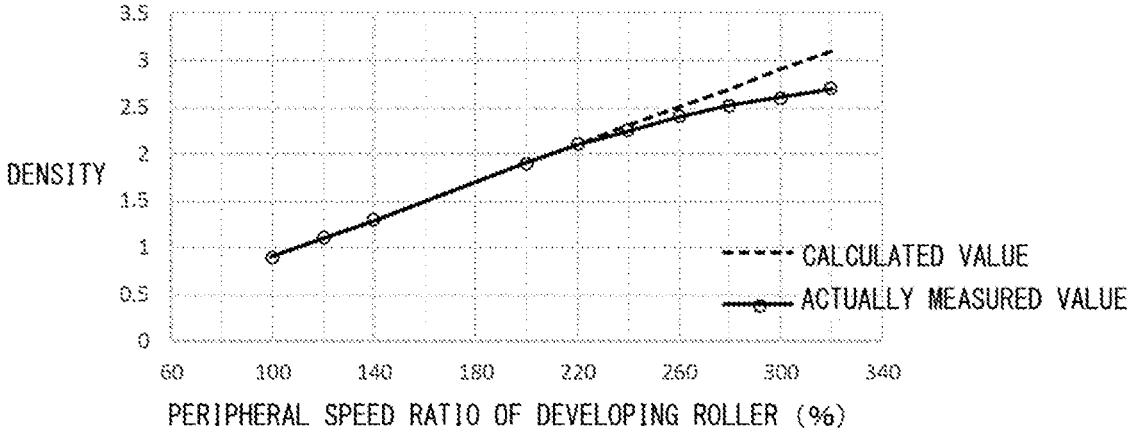
FIG. 9 is a schematic explanatory view showing the relationship between a peripheral speed ratio and the density of the toner patch in a yellow toner in Embodiment 1.

Next, the relationship between the peripheral speed ratio of the developing roller 8 with respect to the photosensitive drum 5 and the sensor output of the optical sensor 80 will be described by using the result in the case of a yellow toner shown in FIG. 9. In a graph in FIG. 9, an ideal sensor output with respect to the peripheral speed ratio is indicated by a broken line, and an actual sensor output example is indicated by a solid line. Note that the graph of the ideal sensor output is formed on the basis of the sensor outputs of the peripheral speed ratios of 100%, 120%, and 140% by using linear interpolation. As shown in FIG. 9, the toner supply amount is saturated at a certain peripheral speed ratio, and hence a difference between the actual sensor output of the toner patch with respect to the peripheral speed ratio and the ideal sensor output increases as the peripheral speed ratio increases from the level of the above peripheral speed ratio. This means that, while the toner supply amount increases, the density of the formed toner patch is saturated. In such a state, the toner, the charge control of which is difficult, is present in the toner patch, and the fogging image may occur. An example shown in FIG. 9 reveals that, in the case of the yellow toner, the sensor output of the optical sensor 80 at the peripheral speed ratio of 220% matches the ideal sensor output, whereas the sensor output of the optical sensor 80 is deviated from the ideal sensor output at the peripheral speed ratio of 240%. From this fact, with regard to the peripheral speed ratio of the developing roller 8 for the yellow toner, the limit value can be set to 240%, and an optimum peripheral speed ratio range can be set to a range of 220% to 240%. Herein, as Comparative Example for the case of the yellow toner, Table shown below indicates whether or not the fogging image has occurred due to the peripheral speed ratio and shows the result of measurement of the density of the toner patch with a Macbeth densitometer (manufactured by Gretag Macbeth).

TABLE 1

| | Peripheral speed ratio | Fogging occurrence | Density |
|---|---|---|---|
| Embodiment 1 | 230% | Not occurred | 1.8 |
| Comparative Example 1 | 260% | Occurred | 1.9 |
| Comparative Example 2 | 200% | Not occurred | 1.5 |

In Embodiment 1, the fogging image does not occur at the peripheral speed ratio of 230% and the density of the toner patch at this point is 1.8. In contrast, at the peripheral speed ratio of 260% in Comparative Example 1, although the density (1.9) is higher than that in Embodiment 1, the fogging image has occurred. At the peripheral speed ratio of 200% in Comparative Example 2, although the fogging image does not occur, the density (1.5) is lower than that in Embodiment 1.

Figure 10A:
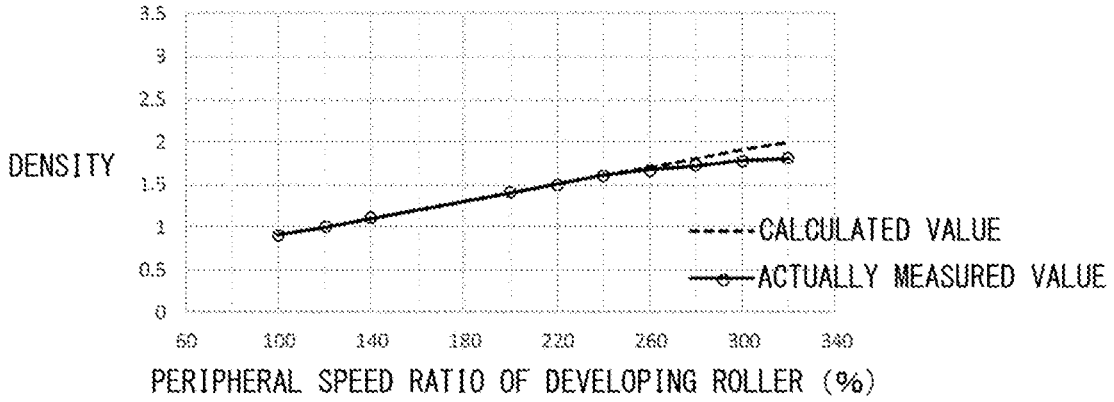
FIGS. 10A to 10C are schematic explanatory views each showing the relationship between the peripheral speed ratio and the density of the toner patch in each of a magenta toner, a cyan toner, and a black toner in Embodiment 1.
Figure 10B:
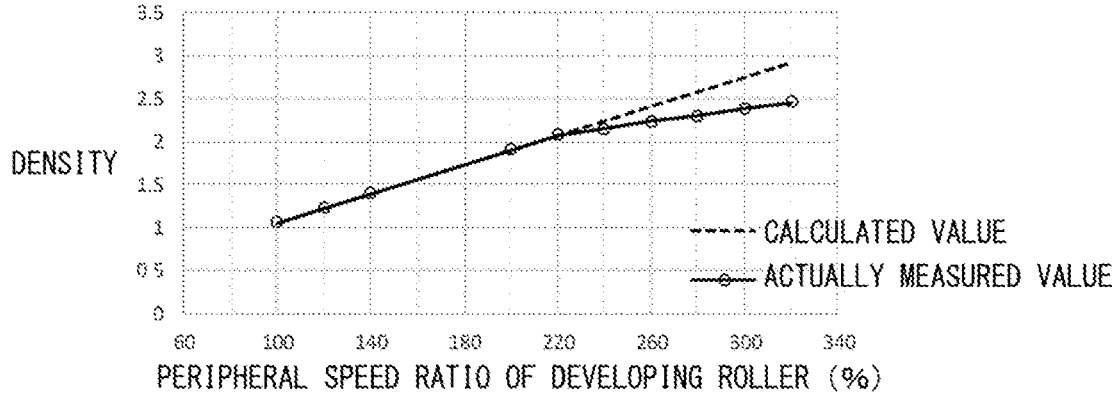
Figure 10C:
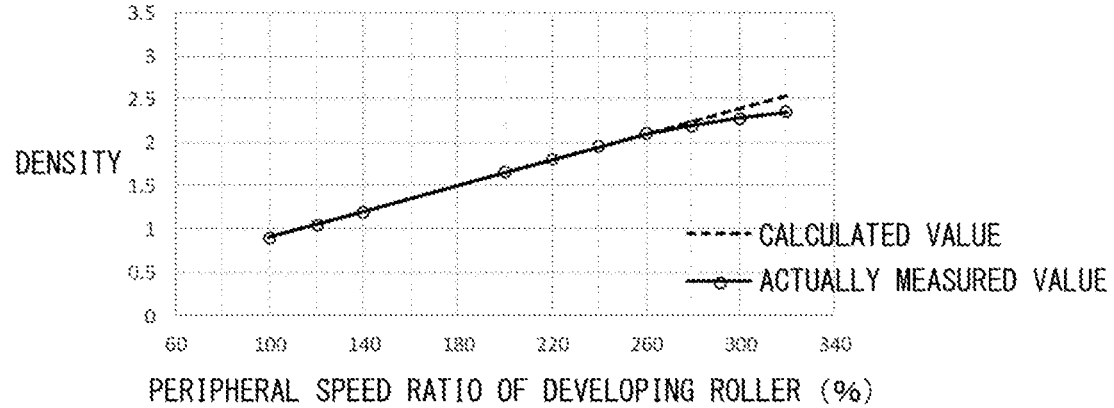

Similarly to the case of the yellow toner described above, for each of a magenta toner, a cyan toner, and a black toner, the limit value of the peripheral speed ratio and the optimum peripheral speed ratio range are identified from the ideal density with respect to the peripheral speed ratio and the density calculated on the basis of the actual sensor output of the optical sensor 80. FIGS. 10A to 10C show graphs in the cases of the magenta toner (FIG. 10A), the cyan toner (FIG. 10B), and the black toner (FIG. 10C) which are prepared in the same manner as that of the case of the yellow toner in FIG. 9. From the graph in FIG. 10A, with regard to the peripheral speed ratio of the developing roller 8 for the magenta toner, it is possible to determine that the limit value is 260%, and the optimum peripheral speed ratio range is from 240% to 260%. In addition, from the graph in FIG. 10B, with regard to the peripheral speed ratio of the developing roller 8 for the cyan toner, it is possible to determine that the limit value is 240%, and the optimum peripheral speed ratio range is from 220% to 240%. Further, from the graph in FIG. 10C, with regard to the peripheral speed ratio of the developing roller 8 for the black toner, it is possible to determine that the limit value is 280%, and the optimum peripheral speed ratio range is from 260% to 280%.

In Embodiment 1, as shown in FIG. 2, the developing rollers 8 (8Y, 8M, 8C, 8K) are caused to rotate in the arrow directions uniformly by the common drive motor M2. Accordingly, among the optimum peripheral speed ratio ranges of the toners of the individual colors determined in the manner described above, the peripheral speed ratio range including the minimum peripheral speed ratio is set as the peripheral speed ratio range which is used where the developing rollers 8 are driven. In the example described above, the peripheral speed ratio range (220% to 240%) of each of the yellow toner and the cyan toner includes the minimum peripheral speed ratio of 220%. Accordingly, the drive motor M2 drives the developing rollers 8 of the individual colors at a peripheral speed ratio in a range of 220% to 240%. Consequently, in the example described above, while the photosensitive drum 5 is rotationally driven at a process speed of 100 mm/s, the developing rollers 8 are preferably driven at 220 to 240 mm/s. For example, the drive motor M2 controls the developing rollers 8 such that the developing rollers 8 are rotationally driven at 230 mm/s.

Next, an example of processing executed by the CPU 31 in Embodiment 1 will be described with reference to a flowchart in FIG. 11. The CPU 31 functions as the control unit by executing the processing shown in FIG. 11 and sets driving conditions of the photosensitive drum 5 and the developing roller 8 including the peripheral speed ratio in the wide color gamut print mode.

In S101, the CPU 31 controls a formation process of the toner patch by the developing roller 8. As a result, the toner patch corresponding to each peripheral speed ratio is formed on the photosensitive drum 5, as described above. The toner patch formed on the photosensitive drum 5 is transferred to the intermediate transfer belt 3.

Next, in S102, the CPU 31 controls the optical sensor 80 to detect the density information of the developer of each toner patch transferred to the intermediate transfer belt 3. Subsequently, in S103, the CPU 31 identifies a deviation point (limit value) described above from the graph in each of FIG. 9 and FIGS. 10A to 10C on the basis of the density information of the developer of the toner patch detected by the optical sensor 80 and determines the optimum peripheral speed ratio range of the developing roller of each color. Further, the CPU 31 identifies, among the optimum peripheral speed ratio ranges of the developing rollers of the individual colors, the peripheral speed ratio range including the minimum peripheral speed ratio.

Subsequently, with the process in S103, among the peripheral speed ratios included in the identified optimum peripheral speed ratio range, the minimum peripheral speed ratio is determined to be a common peripheral speed ratio used when the developing rollers 8 are rotationally driven by the drive motor M2 by the CPU 31. With the process in S103, the peripheral speed ratio of the image bearing member when the density information detected by the detection portion indicates the density which does not generate the fogging of the developer on the image bearing member is identified for each of a plurality of the image bearing members.

Next, in S104, the CPU 31 sets the driving conditions including the peripheral speed ratio in the wide color gamut print mode on the basis of the common peripheral speed ratio determined in S103 and ends the processing of the present flowchart. With this configuration, when the image formation in the wide color gamut print mode is executed in the color laser printer 50, the rotational drive of the developing rollers 8 is controlled by the drive motor M2 on the basis of the driving conditions set in S104. Note that the peripheral speed ratio between the photosensitive drum 5 and the developing roller 8 in the normal print mode is an example of a first peripheral speed ratio included in a first driving condition. In addition, the peripheral speed ratio in the wide color gamut print mode determined in S104 is an example of a second peripheral speed ratio included in a second driving condition.

Figure 11:
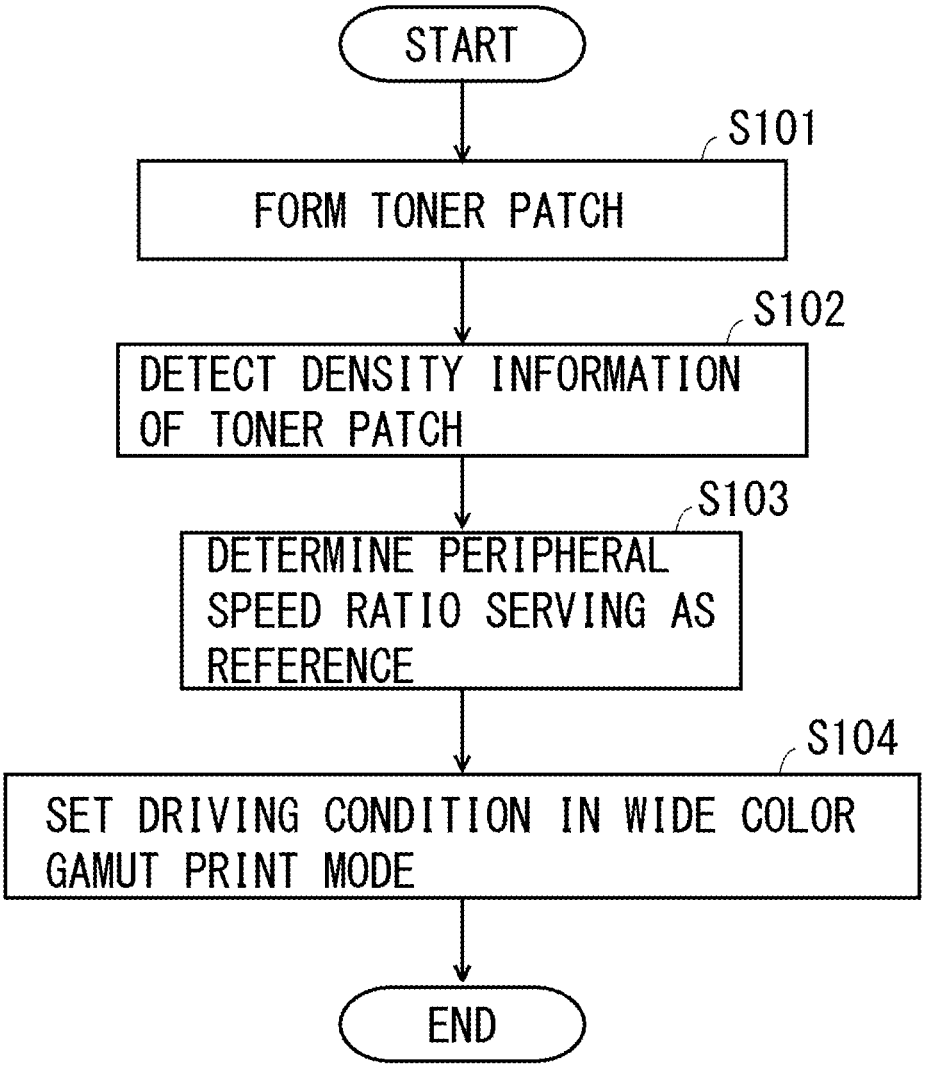
FIG. 11 is a flowchart showing an example of processing executed in the image forming apparatus in Embodiment 1.

Note that, in the description of the flowchart in FIG. 11, in S104, the CPU 31 uses the minimum peripheral speed ratio among the peripheral speed ratios included in the peripheral speed ratio range which is identified for each photosensitive drum 5 in S103 but setting of the peripheral speed ratio is not limited thereto. For example, for the purpose of performing more stable peripheral speed ratio setting, the peripheral speed ratio obtained by multiplying the determined minimum peripheral speed ratio by 0.9 may be set as the common peripheral speed ratio which is actually used. In addition, when a small amount of undeveloped toner (toner which is carried on the developing roller 8 and remains on the developing roller without being moved onto the photosensitive drum 5 by a developing nip) is permitted, the peripheral speed ratio obtained by multiplying the determined minimum common peripheral speed ratio by, e.g., 1.1 may be set as the common peripheral speed ratio which is actually used.

Herein, the limit value of the peripheral speed ratio will be described in greater detail. The amount of toner (developable amount) used for development with the developing potential Vdc is determined according to a product of the capacitance (C) of the photosensitive drum in a developing nip portion where the toner is sandwiched and the developing potential (Vdc) with respect to the total amount of the amount of residual charge of supplied toner. That is, $C \times Vdc$ represents the total amount of the amount of residual charge of the toner per unit area which can move from the developing roller to the photosensitive drum (can be used for the development) in the developing nip portion serving as an opposing portion where the developing roller and the photosensitive drum oppose each other. In addition, the total amount of residual charge of the toner supplied to the photosensitive drum is determined according to the amount of residual charge per unit area on the developing roller (Q/S) and the peripheral speed ratio ($\Delta v$) with respect to the photosensitive drum, and is represented by a product given by $Q/S \times \Delta v$.

Consequently, the amount of the toner which can be used for the development with respect to development contrast is represented by a relational expression of $|Q/S \times \Delta v = |C \times Vdc|$. That is, when $|Q/S \times \Delta v| \leq |C \times Vdc|$ is satisfied by changing the peripheral speed ratio $\Delta v$, the total amount of charge of the toner supplied from the developing roller is less than the amount of charge which can be received by the photosensitive drum. This case serves as a condition under which all of the toner on the developing roller moves to the photosensitive drum (is used for the development). Conversely, when $|Q/S \times \Delta v| > |C \times Vdc|$ is satisfied, the total amount of charge of the toner supplied from the developing roller is larger than the amount of charge which can be received by the photosensitive drum. This case serves as a condition under which, after the toner on the developing roller moves to the photosensitive drum, part of the toner is used for the development, and the remaining toner remains on the developing roller without being used for the development. When the relation given by $|Q/S \times \Delta v| > |C \times Vdc|$ is approached, the limit of the peripheral speed ratio appears.

Figure 12:
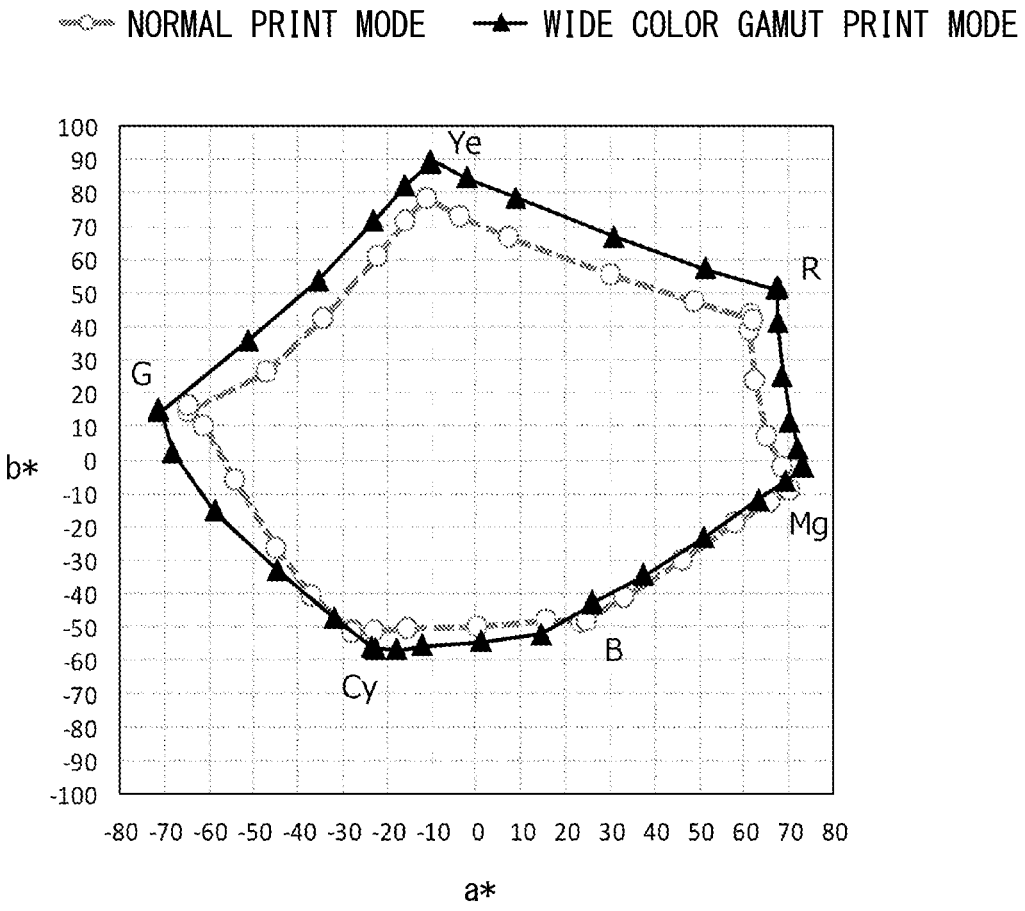
FIG. 12 is a schematic explanatory view of a color gamut in a wide color gamut print mode in Embodiment 1.

Next, FIG. 12 shows an example of the color gamut in the wide color gamut print mode when the rotational drive of the developing roller 8 is controlled in the manner described above. In FIG. 12, a range surrounded by a solid line is a color reproduction range in the wide color gamut print mode, and a range surrounded by a dotted line is a color reproduction range in the normal print mode. From a graph in FIG. 12, it can be seen that the color gamut in the wide color gamut print mode in Embodiment 1 is wider than the color gamut in the normal print mode, and the color reproduction range which can be outputted is widened.

As described thus far, in Embodiment 1, in the configuration in which a plurality of the developing rollers are rotated by the common drive source, in the wide color gamut image formation mode, the peripheral speed ratio range which allows the desired supply amount to be obtained is determined in each of a plurality of the developing rollers. Subsequently, among the determined ranges, the peripheral speed ratio range including the minimum peripheral speed ratio is identified, and the driving conditions including the peripheral speed ratio in the wide color gamut print mode are set on the basis of the peripheral speed ratio in the identified peripheral speed ratio range. Subsequently, the rotational drive of the developing rollers is controlled on the basis of the driving conditions. With this configuration, it can be expected that the wide color gamut image formation will be implemented without increasing the cost and size of the image forming apparatus.

Embodiment 2

Next, hereinbelow, Embodiment 2 will be described. In Embodiment 2, in addition to the control of the developing rollers 8 similar to that in Embodiment 1, the drive source different from the drive source for controlling the drive of the developing rollers 8Y, 8M, and 8C for the color toners is used as the drive source for controlling the drive of the developing roller 8K for the black toner. Note that the other points in Embodiment 2 are the same as those in Embodiment 1, and hence the description of portions which require duplicate descriptions will be omitted.

In Embodiment 1, the developing rollers 8 are rotationally driven by the common drive source, and hence the rotational speed of the developing roller 8K for the black toner is influenced by the rotational speeds of the developing rollers 8Y, 8M, and 8C for the color toners in the wide color gamut print mode. In the wide color gamut print mode, the color gamut in the image formation is enlarged, but the toner supply amount is increased, and hence there are cases where small text or a thin line in an image scatters. Consequently, the image formation in the wide color gamut print mode is performed in a text portion of an output image, and hence there is a possibility that what is called a scattering image occurs.

In view of the possibility, in Embodiment 2, the drive control of the developing roller 8K for the black toner is separated from the drive control of the developing rollers 8Y, 8M, and 8C for the color toners. Accordingly, hereinafter, a case is assumed in which the image formation in the wide color gamut print mode is performed in an image in which an image such as a so-called text image in which the image formation is performed by using only the black toner is present. A description will be given of a method for optimizing only the rotational speed of the developing roller 8K for the black toner corresponding to the photosensitive drum 5K of the black toner in this case.

Figure 13:
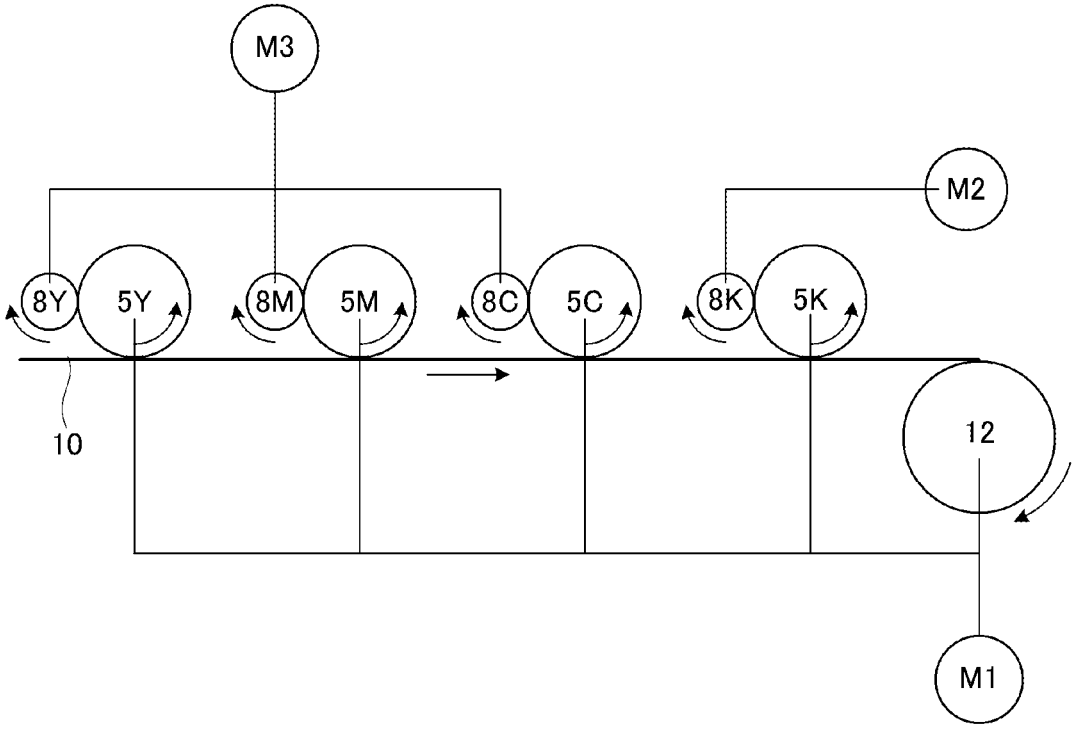
FIG. 13 is a schematic configuration diagram of the drive sources of the photosensitive drums and the developing rollers in Embodiment 2.

FIG. 13 shows an example of the configuration of drive motors M1, M2, and M3 of the photosensitive drums 5 (5Y, 5M, 5C, 5K), the developing rollers 8 (8Y, 8M, 8C, 8K), and the driver roller 12 of the intermediate transfer belt 3 in Embodiment 2. The drive sources in Embodiment 2 are different from those of the photosensitive drums 5, the developing rollers 8, and the driver roller 12 in Embodiment 1 in that the drive control of the developing roller 8 for the black toner is separated from the drive control of the developing rollers 8 for the color toners. In addition, Embodiment 2 is different from Embodiment 1 in that the developing rollers 8Y, 8M, and 8C are rotationally driven by the drive motor M3, and the developing roller 8K is rotationally driven by the drive motor M2.

In Embodiment 2, the CPU 31 executes the processing shown in FIG. 11 to determine the rotational speeds of the developing rollers 8Y, 8M, and 8C corresponding to the color toners. In Embodiment 2, it is possible to optimize the peripheral speed ratio of the developing roller 8K which supplies the black toner used for the image formation of the text image independently of the other developing rollers. Consequently, in the wide color gamut print mode, it is possible to control the developing roller 8K such that the developing roller 8K is driven at the peripheral speed ratio in the normal print mode. As a result, even when the text image is present in the output image, it is possible to obtain both of the color gamut in the wide color gamut print mode and the color gamut in the normal print mode, and hence it can be expected that an image in which scattering does not occur in a portion corresponding to the text image and which has the wide color gamut as the entire image will be obtained.

In Embodiment 2, in a portion in the image where the image formation in the wide color gamut print mode is performed, similarly to Embodiment 1, the drive motor M3 drives the developing rollers 8Y, 8M, and 8C at the peripheral speed ratio within a range of 220% to 240%. Further, in the text portion in the image, the drive motor M2 drives the developing roller 8K for the black toner at the peripheral speed ratio of 100% which is the peripheral speed ratio in the normal print mode. In Embodiment 2, as an example, while the photosensitive drums 5 are driven at a process speed of 100 mm/s, the developing rollers 8Y, 8M, and 8C for the color toners are driven at 230 mm/s, and the developing roller 8K for the black toner is driven at 100 mm/s. Note that, herein, as the peripheral speed ratio of the developing roller 8K for the black toner, the peripheral speed ratio in the normal print mode, i.e., 100 mm/s is used. However, the drive of the developing roller 8K may be controlled at the peripheral speed ratio other than 100 mm/s as long as the peripheral speed ratio falls within a range which does not exceed the peripheral speed ratio in the wide color gamut print mode which is 230 mm/s in this case, i.e., falls within a range of 100 to 230 mm/s and does not cause the scattering.

Consequently, in Embodiment 2, in the configuration in which a plurality of the developing rollers are rotated by the common drive source, in the wide color gamut image formation mode, only the developing roller 8K is driven at the optimum rotational speed in what is called a mono-color mode in which only the black toner is used for the image formation. With this configuration, in the image formation of a monochrome image in the wide color gamut print mode, the rotational speed of the developing roller 8K for the black toner is not influenced by the control of the rotational drive of the developing rollers 8Y, 8M, and 8C for the color toners. In addition, it is possible to implement the wide color gamut image formation while properly increasing the supply amount of the developer supplied to the photosensitive drum 5K.

Embodiment 3

Next, hereinbelow, Embodiment 3 will be described. In Embodiment 3, the color information of the above-described toner patch fixed to the recording material P is detected by the color sensor 90, and the rotational speed of the developing rollers 8 in the wide color gamut print mode is determined on the basis of the detected color information. Note that the configuration of the color laser printer 50 in Embodiment 3 is assumed to be identical to that in Embodiment 1. In addition, in Embodiment 3, the toner patch is individually formed for each color. Further, the toner patches having the same color are formed at intervals for each peripheral speed ratio. Note that, similarly to FIG. 8, the toner patches may be formed so as to be arranged along the rotation direction of the intermediate transfer belt 3.

Figure 14:
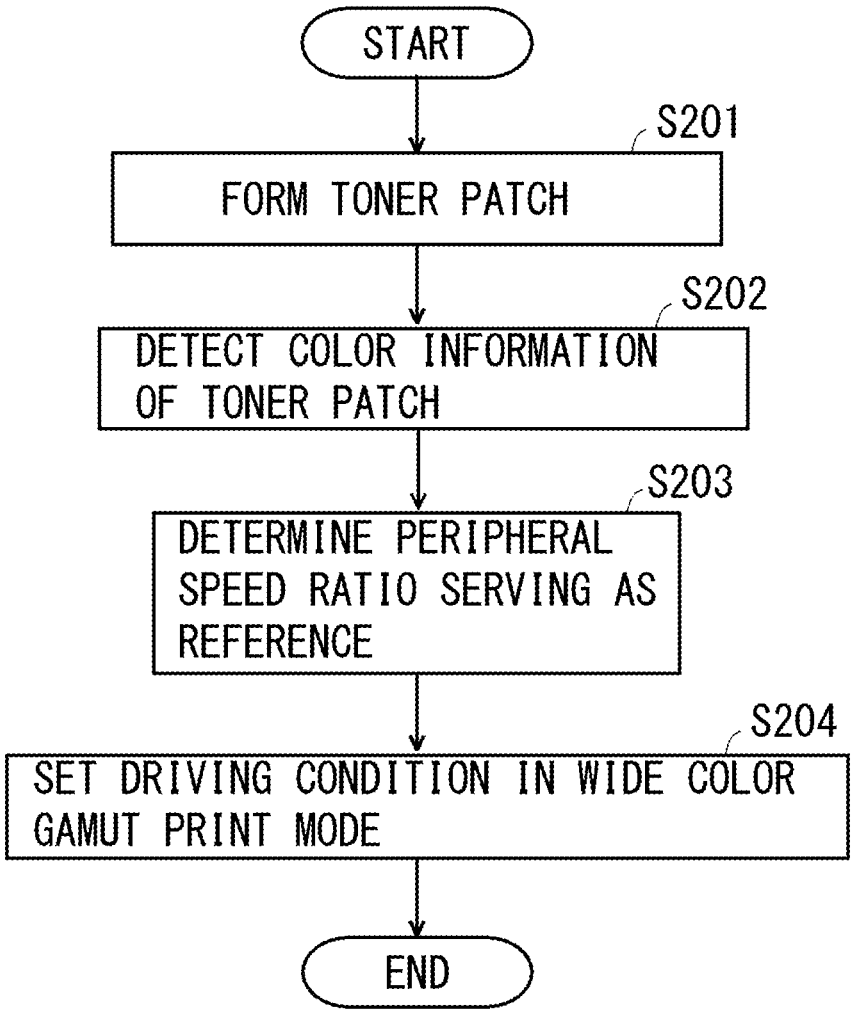
FIG. 14 is a flowchart showing an example of processing executed in the image forming apparatus in Embodiment 2.

An example of processing executed by the CPU 31 will be described with reference to a flowchart in FIG. 14. The CPU 31 executes the processing shown in FIG. 14 to determine the rotational speed of the developing roller 8 of which the drive is controlled by the drive motor M2. In S201, the CPU 31 executes the process of forming the toner patch corresponding to each peripheral speed ratio on the photosensitive drum 5, as described above. The toner patch formed on the photosensitive drum 5 is transferred to the intermediate transfer belt 3. The toner patch transferred to the intermediate transfer belt 3 is transferred to the recording material P and is then fixed to the recording material P by the fixing apparatus 14.

Next, in S202, the CPU 31 controls the color sensor 90 to detect the color information including the chromaticity value of each toner patch fixed to the recording material P. Subsequently, the CPU 31 determines the optimum peripheral speed ratio range of the developing roller of each color on the basis of the rate of change of a hue angle calculated from the detected chromaticity value. The hue angle can be considered as the index of a tinge, and hence the high rate of change of the hue angle of the toner patch probably denotes that the tinge significantly changes. Accordingly, in Embodiment 3, for example, when the rate of change of the hue angle is not less than a threshold value, i.e., the rate of change of the tinge is not less than a threshold value, the CPU 31 determines that the rate of change of the hue angle significantly changes. As the threshold value, the permissible range of the change of the tinge differs from one image forming apparatus to another, and hence a value suitable for each image forming apparatus may be used.

In S203, when the CPU 31 determines that a point where the rate of change of the hue angle significantly changes is present, the CPU 31 determines that the toner bearing amount of the toner patch immediately before the toner patch corresponding to the point has the optimum value. Subsequently, the CPU 31 identifies the peripheral speed ratio between the photosensitive drum and the developing roller set for the toner patch having the toner bearing amount which is determined to have the optimum value. The CPU 31 identifies the peripheral speed ratio for each developing roller of each color in this manner and, among the identified peripheral speed ratios, the minimum peripheral speed ratio is determined to be the common peripheral speed ratio by the CPU 31. With the process in S203, the peripheral speed ratio of the image bearing member when the amount of change of the tinge indicated by the color information detected by the detection portion is less than a predetermined amount is identified for each of a plurality of the image bearing members. Further, any of the identified peripheral speed radios identified for the individual image bearing members (herein, the minimum peripheral speed ratio) is determined to be the common peripheral speed ratio. In addition, for the purpose of performing more stable peripheral speed ratio setting, the peripheral speed ratio obtained by multiplying the determined minimum peripheral speed ratio by, e.g., 0.9 may be set as the common peripheral speed ratio which is actually used. In addition, when a small amount of undeveloped toner (toner which is carried on the developing roller 8 and remains on the developing roller without being moved onto the photosensitive drum 5 by a developing nip) is permitted, the peripheral speed ratio obtained by multiplying the determined minimum common peripheral speed ratio by, e.g., 1.1 may be set as the common peripheral speed ratio which is actually used.

Note that, when the CPU 31 determines that the point where the rate of change significantly changes is not present, among the peripheral speed ratios corresponding to the individual formed toner patches, the maximum peripheral speed ratio is determined to be the common peripheral speed ratio by the CPU 31. Note that the CPU 31 may use the peripheral speed ratio which is not higher than the maximum peripheral speed ratio as the common peripheral speed ratio.

Next, in S204, the CPU 31 sets the driving conditions including the peripheral speed ratio in the wide color gamut print mode on the basis of the common peripheral speed ratio determined in S203 and ends the processing of the present flowchart. With this configuration, when the image formation in the wide color gamut print mode is executed in the color laser printer 50, the rotational drive of the developing rollers 8 is controlled by the drive motor M2 on the basis of the driving conditions set in S204.

Thus, in the present embodiment, by setting the peripheral speed ratio between the photosensitive drum and the developing roller on the basis of the color information of the toner patch fixed to the recording material, it is possible to control the rotational drive of the developing roller such that the optimum toner bearing amount is implemented within a range which does not significantly change the tinge.

Other Embodiments

Note that the description of each embodiment is shown by way of example for description of the present invention, and the present invention can be implemented by appropriately modifying or combining the embodiments without departing from the gist of the invention.

Figure 15:
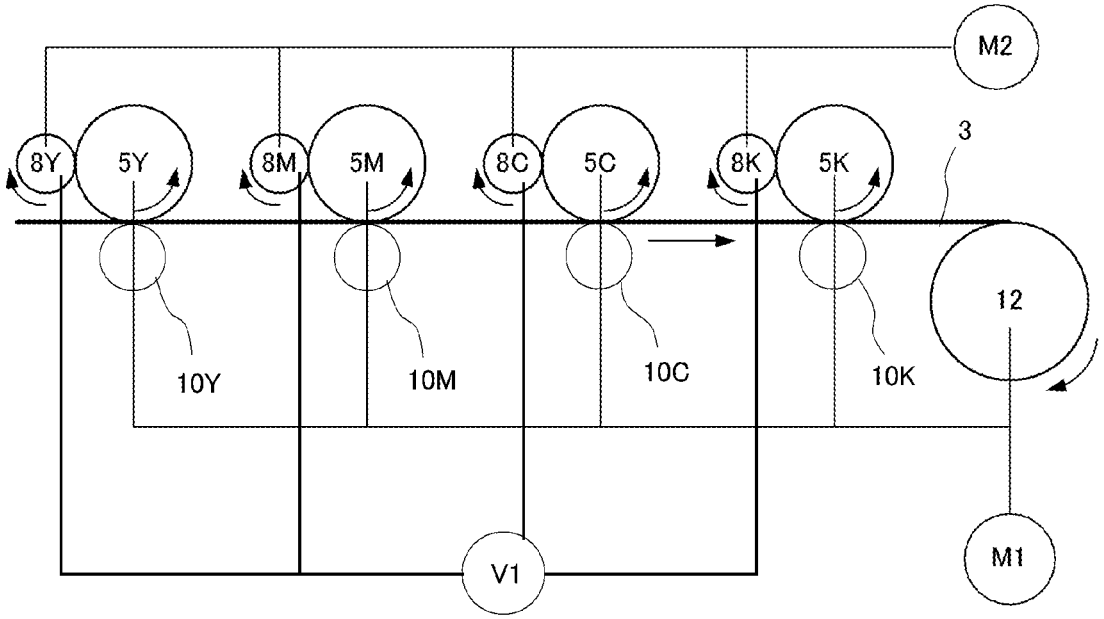
FIG. 15 is a schematic configuration diagram of the drive sources of the photosensitive drums and the developing rollers, and a high-voltage power source in an embodiment.

The capacitance C of the photosensitive drum is given by $C=\varepsilon S/d$ by using a dielectric constant ($\varepsilon$) and a film thickness (d) of the photosensitive drum, and a contact area (S) between the photosensitive drum and the developing roller. In addition, the amount of charge Q of the toner on the photosensitive drum is given by $Q=CV$. Consequently, in the configuration of each embodiment described above, as shown in FIG. 15, when a high-voltage power source V1 for applying the developing potential Vdc to each of a plurality of the developing rollers 8Y, 8M, 8C, and 8K is used in common by the developing rollers, it is not possible to control the amount of charge of the toner for each photosensitive drum by using V. As a result, the above problem related to the saturation of the toner supply amount may become more conspicuous. Also in such a configuration, it can be expected that the wide color gamut image formation will be implemented by each embodiment described above.

In addition, in each embodiment described above, the CPU 31 determines the rotational speed of the developing roller 8 on the basis of the determined peripheral speed ratio in the wide color gamut print mode. However, the CPU 31 may determine the rotational speed of the photosensitive drum 5 instead of the rotational speed of the developing roller 8. With this configuration, in the color laser printer 50, also in a configuration in which the rotational speed of the developing roller 8 is constant and the rotational speed of the photosensitive drum 5 is variable, it can be expected that the wide color gamut image formation will be implemented by each embodiment described above.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-172918, filed on Sep. 14, 2018, which is hereby incorporated by reference herein in its entirety.

What is claimed is:

1. An image forming apparatus comprising:

a plurality of rotatable image bearing members;

a plurality of rotatable developer carrying members configured to come into contact with the plurality of image bearing members to supply a developer to the plurality of image bearing members;

a drive portion configured to simultaneously perform rotational drive of at least two of the plurality of developer carrying members;

a control unit configured to control the rotational drive by the drive portion and formation of a toner patch on each of the plurality of image bearing members; and a detection portion configured to detect information related to the developer of the toner patch, wherein ratios between each of the at least two developer carrying members in the rotational drive and the respective image bearing member disposed in correspondence thereto are represented by peripheral speed ratios, wherein modes of controlling, by the control unit, the rotational drive of the drive portion include:

a first mode that uses a first driving condition including a first peripheral speed ratio, among the peripheral speed ratios; and a second mode that uses a second driving condition including a second peripheral speed ratio, among the peripheral speed ratios, which is higher than the first peripheral speed ratio, and wherein the control unit is configured to:

control the respective image bearing members in correspondence to the at least two developer carrying members to perform the formation of the toner patch for each of peripheral speed ratios in a state of simultaneously performing rotational drive of the at least two developer carrying members; and set the second driving condition on the basis of the information of each toner patch formed by the at least two developer carrying members for each of the peripheral speed ratios, the information being detected by the detection portion.

2. The image forming apparatus according to claim 1, further comprising:

an intermediate transfer member; and a transfer portion configured to transfer the toner patch formed on each of the respective image bearing members in correspondence to the at least two developer carrying members for each of the peripheral speed ratios to the intermediate transfer member, wherein the detection portion detects density information of the developer of the toner patch formed on the transfer portion for each of the peripheral speed ratios, and wherein the control unit sets the second driving condition on the basis of a change of the density information of each toner patch formed for each of the peripheral speed ratios detected by the detection portion.

3. The image forming apparatus according to claim 1, further comprising:

a fixing portion configured to fix the toner patch transferred to a recording material for each of the peripheral speed ratios, wherein the detection portion detects color information of the toner patch on the recording material fixed by the fixing portion for each of the peripheral speed ratios, and wherein the control unit sets the second driving condition on the basis of a change of the color information of each toner patch, fixed for each of the different speed ratios, detected by the detection portion.

4. The image forming apparatus according to claim 3, wherein:

the control unit identifies the peripheral speed ratio of each image bearing members in correspondence to the at least two developer carrying members when an amount of change of a tinge indicated by the color information detected by the detection portion is less than a predetermined amount for the respective image bearing member, and the control unit determines any of the identified peripheral speed ratios of the respective image bearing members to be the second peripheral speed ratio.

5. The image forming apparatus according to claim 1, wherein each of the at least two developer carrying members does not supply a black developer to the respective image bearing member.

6. The image forming apparatus according to claim 1, wherein the control unit sets the second driving condition on the basis of the information of the toner patch formed at, among the peripheral speed ratios, a peripheral speed ratio at which a supply amount of the developer supplied to one of the respective image bearing members in correspondence to the at least two developer carrying members saturates.

7. The image forming apparatus according to claim 1, wherein a power source serves as common power source to simultaneously apply a developing potential to the at least two developer carrying members.

8. A method of controlling an image forming apparatus, including a plurality of rotatable image bearing members, a plurality of rotatable developer carrying members configured to come into contact with the plurality of image bearing members to supply a developer to the plurality of image bearing members, a drive portion configured to simultaneously perform rotational drive of at least two of the plurality of developer carrying members, a control unit configured to control the rotational drive by the drive portion and formation of a toner patch on each of the plurality of image bearing members, and a detection portion configured to detect information related to the developer of the toner patch, wherein ratios between each of the at least two developer carrying members in the rotational drive and the respective image bearing member disposed in correspondence thereto are represented by peripheral speed ratios, the method comprising:

controlling, with the control unit, the drive portion to perform the rotational drive in:

a first mode that uses a first driving condition including a first peripheral speed ratio, among the peripheral speed ratios; and a second mode that uses a second driving condition including a second peripheral speed ratio, among the peripheral speed ratios, which is higher than the first peripheral speed ratio;

controlling, with the control unit, the respective image bearing members in correspondence to the at least two developer carrying members to perform the formation of the toner patch for each of peripheral speed ratios in a state of simultaneously performing rotational drive of the at least two developer carrying members; and setting, with the control unit, the second driving condition on the basis of the information of each toner patch formed by the at least two developer carrying members for each of the peripheral speed ratios, the information being detected by the detection portion when the control unit controls the rotational drive by the drive portion using the second mode.

9. A non-transitory computer readable medium storing a program executably by a computer of an image forming apparatus to execute a method, the image forming apparatus including a plurality of rotatable image bearing members, a plurality of rotatable developer carrying members configured to come into contact with the plurality of image bearing members to supply a developer to the plurality of image bearing members, a drive portion configured to simultaneously perform rotational drive of at least two of the plurality of developer carrying members, a control unit configured to control the rotational drive by the drive portion and formation of a toner patch on each of the plurality of image bearing members, and a detection portion configured to detect information related to the developer of the toner patch, wherein ratios between each of the at least two developer carrying members in the rotational drive and the respective image bearing member disposed in correspondence thereto are represented by peripheral speed ratios, the method comprising:

controlling the drive portion to perform the rotational drive in:

a first mode that uses a first driving condition including a first peripheral speed ratio, among the peripheral speed ratios; and a second mode that uses a second driving condition including a second peripheral speed ratio, among the peripheral speed ratios, which is higher than the first peripheral speed ratio;

controlling the respective image bearing members in correspondence to the at least two developer carrying members to perform the formation of the toner patch for each of peripheral speed ratios in a state of simultaneously performing rotational drive of the at least two developer carrying members; and setting the second driving condition on the basis of the information of each toner patch formed by the at least two developer carrying members for each of the peripheral speed ratios, the information being detected by the detection portion when the control unit controls the rotational drive by the drive portion using the second mode.

10. An image forming apparatus comprising:

a plurality of rotatable image bearing members;

a plurality of rotatable developer carrying members configured to come into contact with the plurality of image bearing members to supply a developer to the plurality of image bearing members;

a drive portion configured to simultaneously perform rotational drive of at least two of the plurality of developer carrying members;

an intermediate transfer member;

a transfer portion configured to transfer the toner patch formed on the image bearing member to the intermediate transfer member;

a control unit configured to control the rotational drive by the drive portion and formation of a toner patch on each of the plurality of image bearing members; and a detection portion configured to detect information related to the developer of the toner patch formed on the transfer portion, wherein ratios between each of the at least two developer carrying members in the rotational drive and the respective image bearing member disposed in correspondence thereto are represented by peripheral speed ratios, wherein modes of controlling, by the control unit, the rotational drive of the drive portion include:

a first mode that uses a first driving condition including a first peripheral speed ratio, among the peripheral speed ratios; and a second mode that uses a second driving condition including a second peripheral speed ratio, among the peripheral speed ratios, which is higher than the first peripheral speed ratio, wherein the detection portion detects density information related to the developer of the toner patch formed on the transfer portion for each of the peripheral speed ratios, and wherein the control unit is configured to:

control the respective image bearing members in correspondence to the at least two developer carrying members to perform the formation of the toner patch for each of peripheral speed ratios; and set the second driving condition on the basis of a change of the density information of each toner patch formed by the at least two developer carrying members for each of the peripheral speed ratios, the information being detected by the detection portion.

* * * * *